US008097389B2

(12) United States Patent
Nakamura

(10) Patent No.: US 8,097,389 B2
(45) Date of Patent: Jan. 17, 2012

(54) COLOR TONER FOR FLASH FUSING, METHOD FOR PRODUCING THE SAME, AND ELECTROSTATIC IMAGE DEVELOPER, PROCESS CARTRIDGE, AND IMAGE FORMING APPARATUS USING THE SAME

(75) Inventor: Yasushige Nakamura, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 800 days.

(21) Appl. No.: 12/172,768

(22) Filed: Jul. 14, 2008

(65) Prior Publication Data

US 2009/0087767 A1 Apr. 2, 2009

(30) Foreign Application Priority Data

Oct. 1, 2007 (JP) ..... 2007-257501

(51) Int. Cl.
*G03G 9/09* (2006.01)

(52) U.S. Cl. ..... 430/108.2; 430/106.1; 430/108.1; 430/110.1

(58) Field of Classification Search ..... 430/106.1, 430/108.1, 108.2, 110.1
See application file for complete search history.

(56) References Cited

U.S. PATENT DOCUMENTS

| | | | | |
|---|---|---|---|---|
| 2,417,897 | A | 8/1948 | Adams | |
| 3,491,111 | A | 1/1970 | Lin | |
| 3,491,112 | A | 1/1970 | Lin | |
| 3,624,107 | A | 11/1971 | Lin | |
| 3,627,787 | A | 12/1971 | Lin | |
| 3,853,869 | A | 12/1974 | Farber | |
| 3,971,808 | A | 7/1976 | Baumann et al. | |
| 4,246,318 | A | 1/1981 | Baum | |
| 4,814,320 | A * | 3/1989 | Kawai et al. | 503/220 |
| 6,203,603 | B1 * | 3/2001 | Takayama et al. | 106/31.16 |
| 2002/0106571 | A1 | 8/2002 | Katagiri et al. | |
| 2003/0215732 | A1 * | 11/2003 | Uchida et al. | 430/110.3 |
| 2005/0117919 | A1 * | 6/2005 | Ito et al. | 399/27 |
| 2006/0018688 | A1 * | 1/2006 | Nakamura et al. | 399/336 |
| 2006/0269863 | A1 * | 11/2006 | Nakamura et al. | 430/111.35 |

FOREIGN PATENT DOCUMENTS

| | | |
|---|---|---|
| JP | A-61-95988 | 5/1986 |
| JP | A-62-243653 | 10/1987 |
| JP | A-63-94878 | 4/1988 |

(Continued)

OTHER PUBLICATIONS

Office Action in Australian Patent Application No. 2008203396, dated Jun. 11, 2010.

*Primary Examiner* — Mark F Huff
*Assistant Examiner* — Peter Vajda
(74) *Attorney, Agent, or Firm* — Oliff & Berridge, PLC

(57) ABSTRACT

The invention provides a color toner for flash fusing containing at least: a binder resin, a colorant, a leuco dye, a developer and a decolorizer. An absorbance of the color toner after photoirradiation at a wavelength of about 900 nm is smaller than an absorbance of the color toner before the photoirradiation at the wavelength of about 900 nm. The invention further provides a method for producing the color toner, a electrostatic image developer comprising the color toner, a process cartridge comprising a developer bearing body which accommodates the electrostatic image developer, and an image forming apparatus to form a toner image by the electrostatic image developer.

22 Claims, 1 Drawing Sheet

FOREIGN PATENT DOCUMENTS

| | | |
|---|---|---|
| JP | A-9-152818 | 6/1997 |
| JP | A-2000-35689 | 2/2000 |
| JP | A-2000-63715 | 2/2000 |
| JP | A-2000-352835 | 12/2000 |
| JP | A-2002-129071 | 5/2002 |
| JP | A-2004-137510 | 5/2004 |
| JP | A-2007-240953 | 9/2007 |

* cited by examiner

COLOR TONER FOR FLASH FUSING, METHOD FOR PRODUCING THE SAME, AND ELECTROSTATIC IMAGE DEVELOPER, PROCESS CARTRIDGE, AND IMAGE FORMING APPARATUS USING THE SAME

CROSS-REFERENCE TO RELATED APPLICATION

This application claims priority under 35 USC 119 from Japanese Patent Application No. 2007-257501 filed Oct. 1, 2007.

BACKGROUND

1. Technical Field

The present invention relates to a color toner for flash fusing processes, a process for forming the color toner, an electrostatic image developer, a process cartridge and an image forming apparatus.

2. Related Art

In electrophotographic processes commonly employed in copying machines, printers, printing machines, and the like, images are generally formed in the following manner: the photoconductive insulator surface of a photoreceptor drum is first uniformly charged positively or negatively (in a charging step), and then an electrostatic latent image is formed according to image information by irradiating, for example, a laser beam onto the photoconductive insulator surface and thus partially removing the electrostatic charge on the insulator surface. The latent image is then converted to a visible toner image, for example, by applying fine particles of a developer called toner onto the latent image area retaining the electrostatic charge on the photoconductive insulator. Generally, the toner image obtained in this manner is transferred electrostatically onto a recording medium such as recording paper and then the toner image is fixed on the recording medium in order to produce printed matter.

Various solidification and fusion methods including fusion of the toner by application of heat and/or pressure and fusion of the toner by photoirradiation energy have been used for fixing the toner image after transfer, and flash fusing processes utilizing light, which are advantageous compared with application of heat or pressure, are now attracting more attention. Examples of the flash fusing processes which have been known include a flash fixing process using a xenon lamp, a laser fixing process using a high-intensity laser.

That is, the flash fusing process, which demands no pressure for toner fixation, has an advantage that the resolution (reproducibility) of the toner image is less deteriorated in the fixing step because the image needs not be brought into contact (or pressurized) with, for example, a fixing roller. In addition, such a device allows printing immediately after it is turned on, because it demands no preheating of heat sources such as a fixing roller and thus eliminates the waiting time for the heat sources to be preheated to a desired temperature after it is turned on. Elimination of the high-temperature heat sources is also advantageous in effectively preventing the rise in temperature of the device and in preventing the ignition of recording paper due to the heat from the heat sources even when the recording paper clogs in the fixing device due to system malfunction.

However, when color toners are used for fixing, the flash fusing process is rather lower in fixing efficiency than when a black toner is used, because of the lower light absorption efficiency of the color toners.

Known infrared absorbers for toners have colors such as black, brown or green and may thus exert significant influence on a tone of a toner to which the infrared absorbers are added to cause a fluctuation in a tone of an image obtained therewith after fixation.

SUMMARY

The invention provides a color toner for flash fusing, which improves fusibility of toner images in flash fusing and simultaneously reduces a fluctuation in the tone of the toner image after the fusing, a method for manufacturing the same, an electrostatic image developer, a process cartridge, and an image forming apparatus.

Namely, a first aspect of the invention is a color toner for flash fusing having at least: a binder resin, a colorant, a leuco dye, a developer and a decolorizer, an absorbance of the color toner after photoirradiation at a wavelength of about 900 nm being smaller than an absorbance of the color toner before the photoirradiation at the wavelength of about 900 nm.

A second aspect of the invention is an electrostatic image developer comprising the color toner of the first aspect of the invention.

A third aspect of the invention is a process cartridge comprising a developer bearing body which accommodates the electrostatic image developer of the second aspect of the invention.

A fourth aspect of the invention is an image forming apparatus comprising: a toner image forming member that forms a toner image on a recording medium by using the electrostatic image developer of the second aspect of the invention; and a fusing member to fuse the toner image by photoirradiation so that the fused toner image is fixed onto the recording medium.

Further the fifth aspect of the invention is a method for producing the color toner of the first aspect of the invention, comprising: mixing a color-forming phase component comprising the leuco dye and the developer with a decolorizing phase component comprising the decolorizer; and heating the resultant of the mixing by melt kneading under a condition that the maximum heating temperature is lower than a melting temperature of the decolorizer.

DETAILED DESCRIPTION

Figure 1:
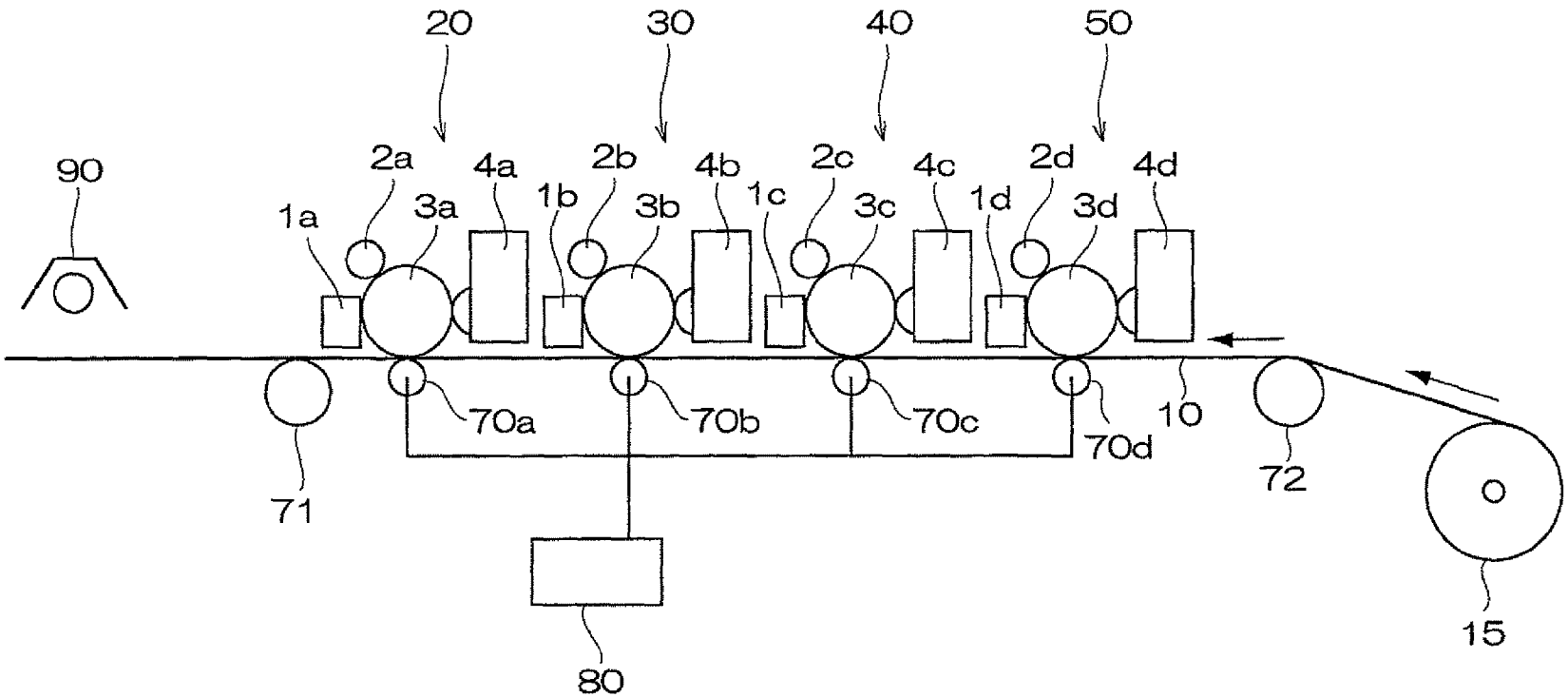
FIG. 1 is a schematic diagram illustrating an example of the image-forming apparatus according to one exemplary embodiment of the invention.

Hereinafter the present invention will be described in detail.

Color Toner for Flash Fusing and Process for Manufacturing the Same

The color toner of an aspect of one exemplary embodiment of the invention (hereinafter sometimes simply referred as a "toner") contains at least a binder resin, a colorant, and, as fusing aids, a leuco dye, a developer and a decolorizer, and an absorbance of the color toner after photoirradiation at a wavelength of about 900 nm is smaller than an absorbance of the color toner before the photoirradiation at the wavelength of about 900 nm.

Color toners used in flash fusing tend to be inferior to ordinary black toners in fusibility since the color toners have low light absorption efficiencies. For improving the light absorption of the color toner for flash fusing to address this issue, an infrared absorber having at least one or more absorption peak in the wavelength range of about 800 nm to about 1,200 nm may be added to the toner to increase the absorbance of the toner so that fusibility can be improved. However, the light absorption range of the infrared absorber is so broad that the infrared absorber also absorbs light with wavelengths of about 600 nm to about 750 nm, and thus causes a fluctuation in the tone of a fused color tone image. Even if a specific dye having a decolorization effect is added, the color tone is not sufficiently decolorized in some cases.

Accordingly there is demand for a fusing aid that upon flash fusing, has effective absorption in a light wavelength range for a lamp or the like for flash fusing, and after fusing, decolorizes without reducing absorption of a colorant, and particularly for a fusing aid that decolorizes by photoirradiation at the time of fusing.

The inventors extensively studied fusing aids capable of decolorization, and as a result, they found that, as described in the following, by using a leuco dye as a colorant and separately arranging in the toner a developer and a decolorizer both acting on the dye, these components may serve as the fusing aid for flash fusing showing the desired decolorization characteristics.

The "fusing aid that decolorizes by photoirradiation" refers to the fusing aid that reduces its maximum absorption peak by irradiation with at least light in the absorption wavelength range of the fusing aid. It is necessary in the exemplary embodiment that the absorbance at about 900 nm of the fusing aid-containing toner measured after the photoirradiation be reduced comparing to that measured before the photoirradiation.

It is preferable that the toner is decolorized by photoirradiation, which is specifically caused by flash fusing. Accordingly, the peak wavelength in the wavelength range of light applied to the toner may be in the range of about 700 nm to about 1,500 nm. The time length of the photoirradiation may be about 0.5 msec to about 10 msec. The absorbance at about 900 nm after the photoirradiation is preferably reduced to about 50% or less, more preferably about 20% or less, with respect to the absorbance measured before the photoirradiation.

The reduction in absorbance at about 900 nm by the photoirradiation may be checked by the following method.

First, a solid image is formed on a PET base having a thickness of about 100 μm by loading a toner in an amount of about 6 g/m$^2$ and then heat-fused with a hot plate at a temperature of up to about 150° C., which is lower than the melting temperature of the decolorizer. This sheet is measured for its absorbance at about 900 nm with a UV-visible spectrophotometer U-4000 (trade name, manufactured by Hitachi, Ltd.). Then, this sheet is photoirradiated for flash fusing. Then, the absorbance of the irradiated sheet is measured at about 900 nm under the same conditions as described above and compared with the absorbance measured before the photoirradiation so as to determine the degree of reduction in absorbance.

The color toner for flash fusing in the exemplary embodiment contains the fusing aids that decolorize by the photoirradiation, in addition to a binder resin and a colorant. Specifically, the color toner for flash fusing contains, as the fusing aids, a leuco dye, a developer and a decolorizer. By selecting a suitable leuco dye and regulating the regions to which the developer and the decolorizer are provided in the toner, the toner may satisfy both the fusibility and color reproducibility. In this case, an infrared absorber may not necessarily be contained in the toner, but an infrared absorber may be contained in the toner as long as an amount thereof is in such a range that the tone of an image obtained by fusing is not influenced.

Hereinafter, the configuration of the color toner for flash fusing in the exemplary embodiment is described in detail.

Fusing Aid

The fusing aids that decolorize by photoirradiation are a leuco dye, a developer and a decolorizer.

Leuco Dye

The leuco dye used in the toner of the exemplary embodiment is not particularly limited as long as it is excellent in dispersibility in a binder resin and the like and does not adversely affect toner characteristics. The leuco dye is a dye precursor that is colorless by itself or is lightly colored. The leuco dye is colored by interacting with the developer described in the following.

Examples of the leuco dye that may be used in the invention include various compounds conventionally known in the art, such as triphenyl methane phthalide compounds, fluoran compounds, phenothiazine compounds, indolyl phthalide compounds, leucoauramine compounds, rhodamine lactam compounds, triphenyl methane compounds, triazene compounds, spiropyran compounds, or fluorene compounds.

Specific examples of the phthalide compounds include those described in, for example, U.S. reissued Pat. No. 23024, U.S. Pat. Nos. 3,491,111, 3,491,112, 3,491,116 and 3,509,174; specific examples of the fluoran compounds include those described in, for example, U.S. Pat. Nos. 3,624,107, 3,627,787, 3,641,011, 3,462,828, 3,681,390, 3,920,510 and 3,959,571; specific examples of the spirodipyran compounds include those described in, for example, U.S. Pat. No. 3,971,808; specific examples of the pyridine compounds and pyrazine compounds include those described in, for example, U.S. Pat. Nos. 3,775,424, 3,853,869 and 4,246,318; and examples of the fluorene compounds include those described in, for example, JP-A No. 63-94878.

Specific examples of the triaryl methane compounds include 3,3-bis(p-dimethylaminophenyl)-6-dimethylaminophthalide, 3,3-bis(p-dimethylaminophenyl)phthalide, 3-(p-dimethylaminophenyl)-3-(1,3-dimethylindol-3-yl)phthalide, and 3-(p-dimethylaminophenyl)-3-(2-methylindol-3-yl)phthalide and the like; specific examples of the diphenylmethane compounds include 4,4'-bis-dimethylaminobenzhydrynbenzyl ether, N-halophenylleucoauramine, and N-2,4,5-trichlorophenylleucoauramine and the like; specific examples of the xanthene compounds include rhodamine-B-anilinolactam, rhodamine-(p-nitroanilino)lactam, 2-(dibenzylamino)fluoran, 2-anilino-3-methyl-6-diethylaminofluoran, 2-anilino-3-methyl-6-dibutylaminofluoran, 2-anilino-3-methyl-6-N-ethyl-N-isoamylaminofluoran, 2-anilino-3-methyl-6-N-methyl-N-cyclohexylaminofluoran, 2-anilino-3-chlor-6-diethylaminofluoran, 2-anilino-3-methyl-6-N-ethyl-N-isobutylaminofluoran, 2-anilino-6-dibutylaminofluoran, 2-anilino-3-methyl-6-N-methyl-N-tetrahydrofurfurylaminofluoran, 2-anilino-3-methyl-6-piperidinoaminofluoran, 2-(o-chloroanilino)-6-diethylaminofluoran, and 2-(3,4-dichloranilino)-6-diethylaminofluoran; specific examples of the thiazine compounds include benzoyl leucomethylene blue and p-nitrobenzyl leucomethylene blue; and specific examples of the spirodipyran compounds include 3-methyl-spiro-dinaphthopyran, 3-ethyl-spiro-dinaphthopyran, 3,3'-di chloro-spiro-dinaphthopyran, 3-benzyl-spiro-dinaphthopyran, 3-methyl-naphtho-(3-methoxy-benzo)-spiropyran and 3-propyl-spiro-dibenzopyran.

Among these compounds, the leuco dye which can be used in the exemplary embodiment is an infrared absorbing leuco dye which has absorption in about 800 nm to about 1,200 nm when it is in a state interacted with a developer. The infrared absorbing leuco dye may be used in combination not only with an infrared absorber but also with another leuco dye that colors with visible light.

Leuco dyes having the absorption in the range of about 800 nm to about 1,200 nm can be used when it is in a state interacted with a developer. The reason is that when a xenon flash lamp, for example, is used as a flash fusing device, the emission wavelength region of the xenon flash lamp is mainly about 800 nm or more, and when a laser fusing method is used for flash fusing, a semiconductor laser having brightness in about 800 nm to about 1,000 nm can be used as a flash fusing device.

An absorption peak of the leuco dye in a color-forming state is preferably in the range of about 800 nm to about 1,000 nm, and is more preferably in the range of about 820 nm to about 910 nm.

When the absorption peak is in the range, a color toner may attain sufficient fusibility by being fused with a flash fusing device which uses a xenon flash lamp or the like, even if a main absorption of the color toner is in the visible light range.

Examples of the leuco dye which has an absorption peak in about 800 nm to about 1,000 nm include a compound represented by the following Formula (I).

Formula (I)

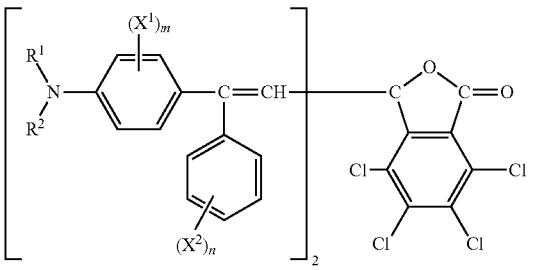

In Formula (I), $R^1$ represents an alkyl group having 1 to 8 carbon atoms; $R^2$ represents an alkyl group having 1 to 8 carbon atoms, a cycloalkyl group having 5 to 7 carbon atoms, a benzyl group that may have one or more substituent selected from a chlorine atom, a bromine atom and an alkyl group having 1 to 4 carbon atoms, or a phenyl group that may have one or more substituent selected from a chlorine atom, a bromine atom and an alkyl group having 1 to 4 carbon atoms; $X^1$ and $X^2$ each independently represent an alkyl group having 1 to 8 carbon atoms, an alkoxy group having 1 to 8 carbon atoms, a fluorine atom, a chlorine atom, a bromine atom, or a combination thereof; and m and n each represent an integer of 0 to 3.

Specific examples of the compounds represented by Formula (I) include 3,3-bis[2-(p-dimethylaminophenyl)-2-phenylethenyl]-4,5,6,7-tetrachlorophthalide, 3,3-bis[2-(p-dimethylaminophenyl)-2-(p-methylphenyl)ethenyl]-4,5,6,7-tetrachlorophthalide, 3,3-bis[2-(p-dimethylaminophenyl)-2-(p-methoxyphenyl)ethenyl]-4,5,6,7-tetrachlorophthalide, 3,3-bis[2-(p-dimethylaminophenyl)-2-(p-ethoxyphenyl) ethenyl]-4,5,6,7-tetrachlorophthalide, 3,3-bis[2-(p-dimethylaminophenyl)-2-(m, p-dimethylphenyl) ethenyl]-4,5,6,7-tetrachlorophthalide, 3,3-bis[2-(p-dimethylaminophenyl)-2-(o-methyl-p-methoxyphenyl)ethenyl]-4,5,6,7-tetrachlorophthalide, 3,3-bis[2-(p-dimethylaminophenyl)-2-(p-propoxyphenyl)ethenyl]-4,5,6,7-tetrachlorophthalide, 3,3-bis[2-(p-dimethylamino-o-methylphenyl)-2-phenylethenyl]-4,5,6,7-tetrachlorophthalide, 3,3-bis[2-(p-dimethylamino-o-chlorophenyl)-2-(p-methylphenyl)ethenyl]-4,5,6,7-tetrachlorophthalide, 3,3-bis[2-(p-dimethylamino-m-methylphenyl)-2-(p-methoxyphenyl)ethenyl]-4,5,6,7-tetrachlorophthalide, 3,3-bis[2-(p-dimethylamino-o-ethylphenyl)-2-(p-methoxyphenyl)ethenyl]-4,5,6,7-tetrachlorophthalide, 3,3-bis[2-(p-dimethylaminophenyl)-2-(p-chlorophenyl)ethenyl]-4,5,6,7-tetrachlorophthalide, 3,3-bis[2-(p-dimethylaminophenyl)-2-(o, p-dimethoxyphenyl) ethenyl]-4,5,6,7-tetrachlorophthalide, 3,3-bis[2-(p-dimethylaminophenyl)-2-(m, p-dimethoxyphenyl)ethenyl]-4,5,6,7-tetrachlorophthalide, 3,3-bis[2-(p-dimethylaminophenyl)-2-(m-methoxyphenyl)ethenyl]-4,5,6,7-tetrachlorophthalide, 3,3-bis[2-(p-diethylaminophenyl)-2-(p-methoxyphenyl)ethenyl]-4,5,6,7-tetrachlorophthalide, 3,3-bis[2-(p-dipropylaminophenyl)-2-(p-methylphenyl) ethenyl]-4,5,6,7-tetrachlorophthalide, 3,3-bis[2-(p-dibutylamino-o-methylphenyl)-2-(p-methoxyphenyl)ethenyl]-4,5,6,7-tetrachlorophthalide, 3,3-bis[2-(p-dihexylaminophenyl)-2-phenylethenyl]-4,5,6,7-tetrachlorophthalide, 3,3-bis[2-(p-methylbutylaminophenyl)-2-(p-methoxyphenyl)ethenyl]-4,5,6,7-tetrachlorophthalide, 3,3-bis[2-(p-dimethylaminophenyl)-2-(p-octylphenylethenyl)-4,5,6,7-tetrachlorophthalide, 3,3-bis[2-(p-dimethylaminophenyl)-2-(p-hexyloxyphenyl)ethenyl]-4,5,6,7-tetrachlorophthalide, 3,3-bis[2-(p-methylcyclohexylaminophenyl)-2-(p-methylphenyl)ethenyl]-4,5,6,7-tetrachlorophthalide, 3,3-bis[2-(p-ethylbenzylaminophenyl)-2-(p-methoxyphenyl)ethenyl]-4,5,6,7-tetrachlorophthalide, and 3,3-bis[2-(p-ethyltolylaminophenyl)-2-phenylethenyl]-4,5,6,7-tetrachlorophthalide and the like, A method for synthesizing these compounds is described in JP-A No. 62-243653.

Each of these leuco dyes may be used singly or in a mixture of two or more thereof for regulation of tone and image density, regulation of electrostatic characteristics and regulation of decolorization properties.

The addition amount of the leuco dye is about 0.5 part by mass to about 10.0 parts by mass, and is preferably about 2.0 parts by mass to about 4.0 parts by mass, with respect to 100 parts by mass of the toner.

Developer

The developer in the exemplary embodiment is not particularly limited as long as it may interact with the leuco dye to form color. Examples of the developer include phenol compounds, sulfur-containing phenol compounds, organic carboxylic acid compounds (for example, salicylic acid, stearic acid and resorcinol acid) and metal salts thereof or the like, sulfonic acid compounds, urea or thio urea compounds or the like, acid clay, bentonite, novolak resin, metal-treated novolak resin, and metal complexes.

These examples are described in Japanese Patent Application Publication (JP-B) No. 40-9309, JP-B No. 45-14039, JP-A No. 52-140483, JP-A No. 48-51510, JP-A No. 57-210886, JP-A No. 58-87089, JP-A No. 59-11286, JP-A No. 60-176795, and JP-A No. 61-95988.

Specific examples thereof include phenols such as p-(dodecylthio)phenol, p-(tetradecylthio)phenol, p-(hexadecylthio)phenol, p-(octadecylthio)phenol, p-(eicosylthio)phenol, p-(docosylthio)phenol, p-(tetracosylthio)phenol, p-(dodecyloxy)phenol, p-(tetradecyloxy)phenol, p-(hexadecyloxy)phenol, p-(octadecyloxy)phenol, p-(eicosyloxy)phenol, p-(docosyloxy)phenol, p-(tetracosyloxy)phenol, p-dodecylcarbamoylphenol, p-tetradecylcarbamoylphenol, p-hexadecylcarbamoylphenol, p-octadecylcarbamoylphenol, p-eicosylcarbamoylphenol, p-docosylcarbamoylphenol, p-tetracosylcarbamoylphenol, hexadecyl gallate, octadecyl gallate, eicosyl gallate, docosyl gallate, or tetracosyl gallate, and phenol metal salts;

carboxylic acids such as α-hydroxydecanoic acid, α-hydroxytetradecanoic acid, α-hydroxyhexadecanoic acid, α-hydroxyoctadecanoic acid, α-hydroxypentadecanoic acid, α-hydroxyeicosanoic acid, α-hydroxydocosanoic acid, α-hydroxytetracosanoic acid, α-hydroxyhexacosanoic acid, α-hydroxyoctacosanoic acid, 2-chlorooctadecanoic acid, heptadecafluorononadecanoic acid, 2-bromohexadecanoic acid, 2-bromoheptadecanoic acid, 2-bromooctadecanoic acid, 2-bromoeicosanoic acid, 2-bromodocosanoic acid, 2-bromotetracosanoic acid, 3-bromooctadecanoic acid, 3-bromoeicosanoic acid, 2,3-dibromooctadecanoic acid, 2-fluorododecanoic acid, 2-fluorotetradecanoic acid, 2-fluorohexadecanoic acid, 2-fluorooctadecanoic acid, 2-fluoroeicosanoic acid, 2-fluorodocosanoic acid, 2-iodohexadecanoic acid, 2-iodooctadecanoic acid, 3-iodohexadecanoic acid, 3-octadecanoic acid, perfluorooctadecanoic acid, 2-oxododecanoic acid, 2-oxotetradecanoic acid, 2-oxohexadecanoic acid, 2-oxooctadecanoic acid, 2-oxoeicosanoic acid, 2-oxotetracosanoic acid, 3-oxododecanoic acid, 3-oxotetradodecanoic acid, 3-oxohexadecanoic acid, 3-oxooctadecanoic acid, 3-oxoeicosanoic acid, 3-oxotetracosanoic acid, 4-oxohexadecanoic acid, 4-oxoheptadecanoic acid, 4-oxooctadecanoic acid, 4-oxodocosanoic acid, dodecylmalic acid, tetradecylmalic acid, hexadecylmalic acid, octadecylmalic acid, eicosylmalic acid, docosylmalic acid, tetracosylmalic acid, dodecylthiomalic acid, tetradecylthiomalic acid, hexadecylthiomalic acid, octadecylthiomalic acid, eicosylthiomalic acid, docosylhiomalic acid, tetracosylthiomalic acid, dodecyldithiomalic acid, tetradecyldithiomalic acid, hexadecyldithiomalic acid, octadecyldithiomalic acid, eicosyldithiomalic acid, docosyldithiomalic acid, tetracosyldithiomalic acid, dodecylbutanedioic acid, tridecylbutanedioic acid, tetradecylbutanedioic acid, pentadecylbutanedioic acid, octadecylbutanedioic acid, eicosylbutanedioic acid, docosylbutanedioic acid, 2,3-dihexadecylbutanedioic acid, 2,3-dioctadecylbutanedioic acid, 2-methyl-3-dodecylbutanedioic acid, 2-methyl-3-tetradecylbutanedioic acid, 2-methyl-3-hexadecylbutanedioic acid, 2-ethyl-3-dodecylbutanedioic acid, 2-propyl-3-decylbutanedioic acid, 2-octyl-3-hexadecylbutanedioic acid, 2-tetradecyl-3-octadecylbutanedioic acid, dodecylmalonic acid, tetradecylmalonic acid, hexadecylmalonic acid, octadecylmalonic acid, eicosylmalonic acid, docosylmalonic acid, tetracosylmalonic acid, didodecylmalonic acid, ditetradecylmalonic acid, dihexadecylmalonic acid, dioctadecylmalonic acid, dieicosylmalonic acid, didocosylmalonic acid, methyloctadecylmalonic acid, methyleicosylmalonic acid, methyldocosylmalonic acid, methyltetracosylmalonic acid, ethyloctadecylmalonic acid, ethyleicosylmalonic acid, ethyldocosylmalonic acid, ethyltetracosylmalonic acid, 2-dodecyl-pentanedioic acid, 2-hexadecyl-pentanedioic acid, 2-octadecyl-pentanedioic acid, 2-eicosyl-pentanedioic acid, 2-docosyl-pentanedioic acid, 2-dodecyl-hexanedioic acid, 2-pertadecyl-hexanedioic acid, 2-octadecyl-hexanedioic acid, 2-eicosyl-hexanedioic acid, or 2-docosyl-hexanedioic acid, and carboxylic acid metal salts;

organic phosphoric acid compounds such as dodecylphosphonic acid, tetradecylphosphonic acid, hexadecylphosphonic acid, octadecylphosphonic acid, eicosylphosphonic acid, docosylphosphonic acid, tetracosylphosphonic acid, hexacosylphosphonic acid, or octacosylphosphonic acid; and acidic materials such as benzophenone, sulfonic acid, or sulfonates. Particularly, compounds excellent in crystallinity may be preferably used.

These compounds may be used singly or in a mixture of two or more thereof for regulation of decolorization characteristics and the like. Particularly, when the compound represented by Formula (I) is used as the leuco dye, the developer used can be a phenol or a phenol metal salt of hexadecyl gallate, octadecyl gallate, eicosyl gallate, docosyl gallate, tetracosyl gallate or the like.

The amount of the developer added is preferably about 0.3 part by mass to about 20.0 parts by mass, more preferably about 1.0 part by mass to about 10.0 parts by mass, and is further preferably about 1.0 part by mass to about 3.0 parts by mass, with respect to 100 parts by mass of the toner.

As described in the following, the developer is provided in the same phase as that of the leuco dye at the time of production of the toner, and after the production, the leuco dye comes to be in a color-forming state. For attaining an excellent color-forming state, the mass ratio (A/B) of the amount A of the leuco dye added to the amount B of the developer added may be in the range of about 2/0.3 to about 2/20.

Decolorizer

The decolorizer used in the exemplary embodiment functions to decrease the binding between the leuco dye and the developer, and examples of the decolorizer which is specifically effective include cholic acid, lithocholic acid, testosterone and cortisone and modified compounds thereof, which are capable of interaction to cleave a leuco bond which is capable of interacting with the developer.

Specific examples of the decolorizer include polysaccharides such as starch, dextrin, mannan, amylose, glycogen, chitin, or pectin; sugars such as D-glucose, D-mannose, D-galactose, D-fructose, L-sorbose, L-rhamnose, L-fucose, D-ribodesose, α-D-glucose=pentaacetate, acetoglucose, diacetone-D-glucose, D-glucuronic acid, D-galacturonic acid, D-glucosamine, D-fructosamine, D-isoaldaric acid, vitamin C, etythrobic acid, trehalose, saccharose, maltose, cellobiose, gentiobiose, lactose, melibiose, raffinose, gentianose, melezitose, stachyose, methyl=α-glucopyranoside, salicin, amygdalin, euxanthic acid, or 1,2:5,6-diisopropylidene-D-mannitol; proteins such as collagen, Taka-amylase A, casein, germ glycoprotein, or ovalbumin; a polymer material such as polyvinyl alcohol, polyvinyl pyridine, polyvinyl acetal, polyacrylonitrile, polyvinyl imidazole, polyvinyl pyrrole, or polyvinyl carbazole; and cholesterol, lanosterol, lanostadienol, agnosterol, cholestanol, coprostanol, ostreasterol, actiniasterol, spongosterol, clionasterol, cholanic acid, cholic acid, deoxycholic acid, lithocholic acid, methyl cholate, sodium cholate, methyl lithocholate, sodium lithocholate, hyodeoxycholic acid, methyl hyodeoxycholate, sodium glycochenodeoxycholate, sodium glycocholate, sodium glycolithocholate, sodium glycoursodeoxycholate, sodium taurocholate, sodium taurodeoxycholate, testosterone, methyltestosterone, 11α-hydroxymethyltestosterone, hydrocortisone, cholesterol methyl carbonate, α-cholestanol, stigmasterol, α-sitosterol, β-sitosterol, γ-sitosterol, brassicasterol, vitamin D, and ergosterol.

In the exemplary embodiment, the decolorizer is designed such that it does not react with the leuco dye or the developer in the toner until photoirradiation at the time of fusing. Therefore, it is preferable that the decolorizer is not melt at the time of production of the toner. The melting temperature of the decolorizer may be higher than the maximum heating temperature at the time of toner manufacturing described in the following, and specifically, the melting temperature (Tm) is preferably about 100° C. to about 250° C., and is more preferably about 150° C. to about 210° C.

Among the specific decolorizers, examples of decolorizers having the preferable melting temperature include sodium taurodeoxycholate (Tm: 160° C.), lithocholic acid (Tm: 180° C.), cholic acid (Tm: 200° C.), sodium glycocholate (Tm: 230° C.), testosterone (Tm: 150° C.), testosterone propionate (Tm: 110° C.), and β-sitosterol (Tm: 140° C.).

The decolorizers may be used singly or in a mixture of two or more thereof for regulation of decolorization characteristics, electrostatic characteristics, and melt viscosity characteristics. Specifically, examples of the decolorizer which can be used when the compound represented by Formula (I) is used as the leuco dye include sodium taurodeoxycholate (Tm: 160° C.), lithocholic acid (Tm: 180° C.), cholic acid (Tm: 200° C.), and β-sitosterol (Tm: 140° C.).

The amount of the decolorizer added is preferably about 0.2 part by mass to about 20.0 parts by mass, more preferably about 1.0 part by mass to about 10.0 pars by mass, and is still more preferably about 1.0 part by mass to about 4.0 parts by mass, with respect to 100 parts by mass of the toner.

As described in the following, the decolorizer is provided in a phase different from that of the leuco dye at the time of production of the toner, and upon photoirradiation, the decolorizer acts on the leuco dye and the developer to bring about a decolorized state. For attaining an excellent decolorized state, the mass ratio (C/D) of the amount C of the developer added to the amount D of the decolorizer added may be in the range of about 3/0.2 to about 2/20.

The toner in the exemplary embodiment, which is prepared by selecting the leuco dye, the developer and the decolorizer as described above and compounding them in effective amounts, preferably has an absorbance of about 0.2 to about 2, which is more preferably about 0.4 to about 0.8, at about 900 nm when it is measured before photoirradiation.

The absorbance and the decolorization rate may be checked using a sheet which is similar to that used in the determination of the reduction in the absorbance at about 900 nm.

Hereinafter, details of the color toner of one exemplary embodiment of one aspect of the invention, that contains the fusing aids which are decolorized by photoirradiation, is described together with the manufacturing process thereof.

Binder Resin

A conventionally-known binder resin may be used as the binder resin in the exemplary embodiment. Examples of the major component in the binder resin include polyester and polyolefin. Examples thereof further include a copolymer of styrene-acrylic acid or methacrylic acid, polyvinyl chloride, phenol resins, acrylic resins, methacrylic resins, polyvinyl acetate, silicone resins, polyester resins, polyurethane, polyamide resins, furan resins, epoxy resins, xylene resins, polyvinyl butyral, terpene resins, chroman indene resins, petroleum resins and polyether polyol resins. These resins may be used singly or in combination of two or more thereof.

Among them, a polyester resin or a norbornene polyolefin resin may be used from the viewpoint of from the points of durability, transparency, and the like.

The polyester resin that can be used in the exemplary embodiment is described in more detail. Examples of the acid component used in the polyester resin include terephthalic acid, isophthalic acid, orthophthalic acid, and anhydrides thereof among which terephthalic acid and isophthalic acid may be preferable. These acid components may be used singly or in a mixture of two or more thereof. Other acid components may be additionally used in combination with the acid components as long as smell generated therefrom by flash fusing is not problematic. Examples of the additionally-used acid components include maleic acid, fumaric acid, citraconic acid, itaconic acid, glutaconic acid, cyclohexanedicarboxylic acid, succinic acid, adipic acid, sebacic acid, azelaic acid and malonic acid, and also include alkyl- or alkenylsuccinic acid such as n-butylsuccinic acid, n-butenylsuccinic acid, isobutylsuccinic acid, isobutenylsuccinic acid, n-octylsuccinic acid, n-octenylsuccinic acid, n-dodecylsuccinic acid, n-dodecenylsuccinic acid, isododecylsuccinic acid or isododecenylsuccinic acid, and acid anhydrides and lower alkyl esters thereof, as well as other divalent carboxylic acids. For crosslinking the polyester resin, carboxylic acid components of trivalent or more-valency may also be used as the additionally-used acid components in a mixing manner. Examples of the trivalent or more carboxylic acid components can include 1,2,4-benzenetricarboxylic acid, 1,3,5-benzenetricarboxylic acid, other polycarboxylic acids, and anhydrides thereof.

About 80 mol % or more, preferably about 90 mol % or more, and still more preferably about 95 mol % or more of the alcohol component in such polyester resin may consist of alkylene oxide adducts of bisphenol A. When the amount of alkylene oxide adducts of bisphenol A is less than about 80 mol %, the amount of monomers causing smell may become relatively large.

Examples of the alkylene oxide adducts of bisphenol include polyoxypropylene (2.2)-2,2-bis(4-hydroxyphenyl) propane, polyoxypropylene (3.3)-2,2-bis(4-hydroxyphenyl) propane, polyoxyethylene (2.0)-2,2-bis(4-hydroxyphenyl) propane, polyoxyethylene (2.2)-2,2-bis(4-hydroxyphenyl) propane, polyoxypropylene (2.0)-polyoxyethylene (2.0)-2,2-bis(4-hydroxyphenyl)propane, and polyoxypropylene (6)-2,2-bis(4-hydroxyphenyl)propane. These compounds may be used singly or in a mixture of two or more thereof.

In the polyester resin used as the binder resin in the exemplary embodiment, another alcohol component may be additionally used in combination with the alcohol component. Examples of the additionally-used alcohol component include diols such as ethylene glycol, diethylene glycol, triethylene glycol, 1,2-propylene glycol, 1,3-propylene glycol, 1,4-butane diol, neopentyl glycol, 1,4-butene diol, 1,5-pentane diol and 1,6-hexane diol, and other dihydric alcohols such as bisphenol A or hydrogenated bisphenol A.

An alcohol which has three or more hydroxyl groups may be also used as the additionally-used alcohol component. Examples thereof include sorbitol, 1,2,3,6-hexane tetrol, 1,4-sorbitan, pentaerythritol, dipentaerythritol, tripentaerythritol, 1,2,4-butane triol, 1,2,5-pentane triol glycerol, 2-methyl propane triol, 2-methyl-1,2,4-butane triol, trimethylol ethane, trimethylol propane, and other alcohols having three or more hydroxyl groups.

An ordinarily-used esterification catalyst such as zinc oxide, stannous oxide, dibutyltin oxide, or dibutyltin dilaurate may be advantageously used in order to promote the reaction for synthesizing the polyester resin.

The Tg (glass transition temperature) of the binder resin used in the toner may be in the range of about 50° C. to about 70° C.

Colorant

A colorant can be suitably selected and used in the toner in accordance with the color of the toner.

Examples of the colorant for the cyan toner include cyan pigments including C.I. Pigment Blue 1, 2, 3, 4, 5, 6, 7, 10, 11, 12, 13, 14, 15, 15:1, 15:2, 15:3, 15:4, 15:6, 16, 17, 23, 60, 65, 73, 83, and 180; C.I. Vat Cyan 1, 3, and 20, iron blue, cobalt blue, alkali blue lake, phthalocyanine blue, nonmetal phthalocyanine blue, partially chlorinated phthalocyanine blue, Fast Sky Blue, and Indanthren Blue BC; and cyan dyes including C.I. Solvent Cyan 79 and 162; and the like. Among them, C.I. Pigment Blue 15:3 is effective.

Examples of the colorants for magenta toner include magenta pigment such as C.I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 49, 50, 51, 52, 53, 54, 55, 57, 58, 60, 63, 64, 68, 81, 83, 87, 88, 89, 90, 112, 114, 122, 123, 163, 184, 202, 206, 207, and 209, and Pigment Violet 19; magenta dyes such as C.I. Solvent Red 1, 3, 8, 23, 24, 25, 27, 30, 49, 81, 82, 83, 84, 100, 109, and 121, C.I. Disperse Red 9, C.I. Basic Red 1, 2, 9, 12, 13, 14, 15, 17, 18, 22, 23, 24, 27, 29, 32, 34, 35, 36, 37, 38, 39, and 40; Bengala, cadmium red, red lead, mercury sulfide, cadmium, Permanent Red 4R, Lithol Red, pyrazolone red, watching red, calcium salts, Lake Red D, Brilliant Carmine 6B, eosin lake, Rotamine Lake B, alizarin lake, Brilliant Carmine 3B, and the like.

In addition, examples of the colorants for yellow toner include yellow pigments such as C.I. Pigment Yellow 2, 3, 15, 16, 17, 97, 180, 185, and 139; and the like.

The addition amount of each of the colorants above is preferably in the range of about 2 parts by mass to about 15 parts by mass, and more preferably in the range of about 3 parts by mass to about 7 parts by mass, with respect to 100 parts by mass of the toner particle prepared after blending with a binder resin and the like. In a case where the addition amount of the colorant is smaller than about 2 parts by mass, the coloring property of the toner may be deteriorated. In a case where the addition amount of the colorant is larger than about 15 parts by mass, the reproductivity of intermediate color of the toner may be deteriorated due to decrease in transparency.

Other Components

The color toner for flash fusing of one exemplary embodiment of one aspect of the invention may further contain, in addition to the leuco dye and the like, infrared absorbers which are conventionally-known as fusing aids. The infrared absorber added to the toner is a material having at least one or more strong light absorption peaks at a wavelength in the near-infrared region, i.e., in the range of about 800 nm to about 2,000 nm, and may be an organic or inorganic substance.

Specific examples of the additionally-used infrared absorber include cyanine compounds, merocyanine compounds, benzene thiol-based metal complexes, mercaptophenol-based metal complexes, aromatic diamine-based metal complexes, nickel complex compounds, phthalocyanine compounds, anthraquinone compounds, naphthalocyanine compounds, chroconium compounds, aminium compounds, diimmonium compounds, and the like.

Among these, naphthalocyanine compounds, chroconium compounds, aminium compounds, and dimmonium compounds may be used as the additionally-used infrared absorber in a case where it is used in combination with the decolorizable fusing aid.

More specific examples of the additionally-used infrared absorber include nickel metal complex-based infrared absorbers (trade name: SIR-130 and SIR-132, manufactured by Mitsui Chemicals), bis(dithiobenzyl)nickel (trade name: MIR-101, manufactured by Midori Kagaku Co. Ltd.), nickel bis(1,2-bis(p-methoxy phenyl)-1,2-ethylenedithiolate) (trade name: MIR-102, manufactured by Midori Kagaku Co. Ltd.), tetra-n-butylammonium nickel bis(cis-1,2-diphenyl-1,2-ethylene dithiolate) (trade name: MIR-1011, manufactured by Midori Kagaku Co. Ltd.), tetra-n-butylammonium nickel bis (1,2-bis(p-methoxyphenyl)-1.2-ethylenedithiolate) (trade name: MIR-1021, manufactured by Midori Kagaku Co. Ltd.), tetra-n-butyl ammonium nickel bis(4-tert-1,2-butyl-1,2-dithiophenolate) (trade name: BBDT-NI, manufactured by Sumitomo Seika Chemicals Co.), a soluble phthalocyanine (trade name: TX-305A, manufactured by Nippon Shokubai Co., Ltd.), inorganic materials (trade name: Ytterbium UU-HP, manufactured by Shin-Etsu Chemical and indium tin oxide, manufactured by Sumitomo Metal Industries, Ltd.), and the like. These compounds may be used in combination of two or more thereof.

In the exemplary embodiment, the toner can be produced by manufacturing a master batch as described below, and therefore, the infrared absorber may be thermally stable. Specific examples of such infrared absorber include a chroconium compound (trade name: ST-173, manufactured by Fuji Film Corporation) and a naphthalocyanine compound (trade name: SnNc FT-1, manufactured by Sanyo Color Works, Ltd.) or the like.

As described above, the tone of the color toner is significantly influenced by adding these infrared absorbers. Accordingly, the amount of the additionally-used infrared absorber added may be smaller. Accordingly, the amount of the infrared absorber used in combination with the fusing aid to be decolorized by the photoirradiation may be in the range of about 0.01% by mass to about 1% by mass with respect to the total amount of the toner components.

In addition, an antistatic agent or a wax may be added to each of the toners as needed.

Examples of the antistatic agents include known calixarenes, nigrosin-based dyes, quaternary ammonium salts, amino group-containing polymers, metal-containing azo dyes, salicylic acid complex compounds, phenol compounds, azo chromium compounds, azo zinc compounds, and the like. In addition, a magnetic toner containing a magnetic material such as iron powder, magnetite, ferrite, or the like may be used as the toner. In particular, a white magnetic powder (such as that manufactured by Nittetsu Mining Co., Ltd.) may be used for color toners.

Examples of the waxes for use in the toner of one exemplary embodiment of one aspect of the invention include ester waxes, polyethylene, polypropylene, and copolymers of polypropylene and polypropylene; and additionally, polyglycerin waxes, microcrystalline waxes, paraffin waxes, carnauba waxes, sazol wax, montanic acid ester waxes, deacidified carnauba waxes, unsaturated fatty acids such as palmitic acid, stearic acid, montanic acid, brassidic acid, eleostearic acid, and vernolic acid; saturated alcohols such as stearyl alcohol, aralkyl alcohols, behenyl alcohol, carnaubyl alcohol, ceryl alcohol, mericyl alcohol, and long-chain alkyl alcohols having a further longer-chain alkyl group; polyhydric alcohols such as sorbitol; fatty amides such as linoleic amide, oleic amide, and lauric amide; saturated fatty acid bisamides such as methylene bisstearic amide, ethylene biscaprinic amide, ethylene bislauric amide, and hexamethylene bisstearic amide; unsaturated fatty amides such as ethylene bisoleic amide, hexamethylene bisoleic amide, N,N'-dioleyl adipic amide, and N,N'-dioleyl sebacic amide; aromatic bisamides such as m-xylene bisstearic amide and N,N'-distearyl isophthalic amide; fatty acid metal salts (generally called metal soaps) such as calcium stearate, calcium laurate, zinc stearate, and magnesium stearate; aliphatic hydrocarbon waxes grafted with a vinyl monomer such as those of styrene, acrylic acid, or the like; partially esterified compounds prepared from a fatty acid and a polyhydric alcohol such as behenic acid monoglyceride; hydroxyl group-containing methyl ester compounds obtained by hydrogenation of a vegetable oil; and the like.

The phase of the wax is separated from that of the binder resin and the like in the toner. Accordingly, it is preferable to disperse, for example, only the decolorizer in the phase-separating wax as described in the following. From this viewpoint, examples of the wax usable in the color toner for flash fusing of one exemplary embodiment of the invention include ester wax, and a copolymer formed of polypropylene and any one of polyethylene, polypropylene, and polyethylene.

Each of these waxes may be used singly or in combination of two or more thereof. In the exemplary embodiment, the amount of the wax added is preferably in the range of about 0.1 part by mass to about 10 parts by mass, more preferably in the range of about 1 part by mass to about 4 parts by mass, with respect to 100 parts by mass of the finally produced toner particles.

Any one of commonly practiced blending and pulverizing methods, wet granulation methods, and the like may be used for production of the toner of the exemplary embodiment. Examples of the wet granulation methods include suspension polymerization method, emulsion polymerization method, emulsion polymerization coagulation method, soap-free emulsion polymerization method, nonaqueous dispersion polymerization method, in-situ polymerization method, interface polymerization method, emulsion dispersion granulation method, and the like.

In the toner of the exemplary embodiment, a phase-separating structure may be formed in the toner so that the leuco dye and the developer are contained in a phase different from that of the decolorizer in order to prevent interaction between the leuco dye in a color-forming state (leuco dye interacting with the developer) and the decolorizer before photoirradiation. For this purpose, the toner in the exemplary embodiment may be produced with a formulation and a manufacturing process which enable to form a phase-separating structure having at least two or more phases formed in the toner so that the leuco dye and the developer may be arranged in a phase different from that of the decolorizer.

Specifically, a phase-separating structure in the tone can be formed as follows. For example, when a phase-separating structure of resin in the toner is intended to be formed, resins which are different from each other in solubility parameter to some extent (for example, a crystalline resin and an amorphous resin) may be used to form separated resin layers. The utilization of such different resins enables to form the phase-separating structure even if a dry melt kneading method is applied. Even in a case that resins which have similar solubility parameters a re used, a phase-separating structure such as a core-shell structure or the like may be formed by devising the order of addition of resin particles by, for example, using an emulsification aggregation method.

A combination of a resin and a non-resin material may also form a phase-separating structure by melt kneading a binder resin with a release agent (wax), which are usually incompatible with each other due to having solubility parameters separated from each other, to form a phase-separating structure having a wax phase dispersed in the resin.

While the phase-separating structure in the exemplary embodiment cannot be clearly defined, the size and shape thereof are not particularly limited as long as the phase structure is separated to such a degree that a border between the phases can be seen when a section of the prepared toner is observed under a transmission electron microscope (TEM). For example, when the toner has a phase-separating structure in a form of a sea-island structure, the maximum size of the island may be about 0.1 μm to about 4 μm. When the observation of the section with TEM is performed, the section may be subjected to staining treatment or the like to facilitate the observation.

The leuco dye and the developer can be provided to a phase which is separate from a phase to which the decolorizer is provided. For example, the decolorizer and the combination of the leuco dye and developer may be respectively mixed in each of plural resins or each of a resin and a wax, which are to be subjected to phase separation, in advance, so as to prepare a leuco dye-containing phase component (a color phase component) and a decolorizer-containing phase component (a decolorizing phase component), and both components may be combined and mixed with each other to form the phase separation structure while the fusing aids may be separately arranged in the respective phases at the same time.

Either a dry kneading milling method or a wet emulsification aggregation method may be used to separately arrange the fusing aids in the respective phase by preparing the color forming phase component and the decolorizing phase component and then combining and mixing them.

Among the methods described above, it may be more preferable to use the method that includes using a resin and a wax as phase separation-forming components to prepare the color forming phase component and the decolorizing phase component so that the fusing aids are arranged separately in the respective components, since the phase-separating structure can be efficiently formed even when conventional manufacturing processes are used and the decolorization effect of the decolorizer after photoirradiation can be effectively exhibited.

In this case, it may be preferable from the viewpoint of increasing light absorption efficiency that the resin component serving as a major component of the toner is a color forming phase component containing the leuco dye.

When the color toner for flash fusing in the exemplary embodiment is prepared by the kneading milling method, the method essentially includes: mixing the color forming phase component with the decolorizing phase component and the like to prepare a toner composition; and melt kneading (heating), cooling, and milling the toner composition so as to shape the toner composition into toner particles In the exemplary embodiment, preparation of the color forming phase component and the decolorizing phase component is added to the kneading milling method.

Usually, in the kneading milling method, a binder resin, an infrared absorber, an antioxidant, a wax, a charge controlling agent, a pigment or dye as a colorant, and other additives are mixed sufficiently by means of a mixer such as a Henschel mixer or a ball mill and then melt-kneaded by means of a heating kneader such as a heating roll, a kneader or an extruder, so that a toner composition having, in the resins which are made to be compatible with one other, the infrared absorber, antioxidant, pigment, dye, magnetic material etc. dispersed or dissolved is prepared. Then, the toner composition may be solidified by cooling, milled and classified to provide the toner.

The fusing aid components are separately provided in the respective phases in the exemplary embodiment as described above. In view of this, a color forming phase component and a decolorizing phase component, which are formed by separately providing the decolorizer and the combination of the leuco dye and the developer into a binder resin or a wax component, are respectively prepared in advance and then mixed with other toner components to give a toner composition containing an infrared absorber at a desired concentration. In this case, if a binder resin-containing component is used as the color forming phase component, a colorant, an infrared absorber or the like may be contained together in the color forming phase component.

As described above, a binder resin and a wax may be used in formation of the color forming phase component and the decolorizing phase component of the exemplary embodiment. In this case, in view of the relationship in a quantitative ratio therebetween, the binder resin-containing component may be used as a color forming phase component and the wax-containing component as a decolorizer component.

When the binder resin and the wax are used as components of the toner, the mixing ratio (binder resin/wax) in terms of amounts may be in the range of from about 100/0.01 to about 100/5.

When the color forming phase component and the decolorizing phase component are prepared, the fusing aids are added to the respective components such that the leuco dye, the developer and the decolorizer are contained in suitable amounts in the finally produced toner. Accordingly, for example, when the compounding amount of the wax is 5% by mass with respect to the total amount of the toner, the decolorizer should be incorporated in advance into the wax at about 20-fold concentration relative to a concentration of the decolorizer in the finally produced toner so that the decolorizer works as the decolorizer component in the toner.

The color forming phase component and the decolorizing phase component may be prepared by various methods after the fusing aid components and the binder resin or the wax are compounded in advance in the above-described mixing ratio. Hereinafter, some aspects of the methods are illustrated, while the invention is not limited to the followings as long as the spirit of the exemplary embodiment is regarded.

Examples of the methods include: a method in which a component containing the fusing aids and the binder resin or the wax is melt-kneaded with a melt kneader such as a single- or twin-screw extruder, a three-roll mill, a kneader, or a Banbuty mixer; a method in which the fusing aid components are dissolved in a solvent or the like in advance and then added to a resin component or the like, and melt-kneaded by the melt kneader while the solvent is removed; and a method in which the fusing aid components are finely dispersed in a solvent by a wet dispersing machine such as a sand mill, a colloid mill or a ball mill in advance and then added to a resin component or the like, and melt-kneaded by the melt kneader while the solvent is removed.

The color forming phase component and the decolorizing phase component may be prepared not only by the melt-kneading method but also by a polymerization method. Examples of the method of finely dispersing the fusing aid components in a liquid such as a polymerizable monomer, a solvent or the like include methods using a high-speed shearing disperser such as a homomixer, a bio-mixer or an Ebara milder, a milling disperser such as a colloid mill or a Homomic Line mill, and a media mill such as a ball mill, a side grind mill, a pearl mill or an attritor.

Examples of the method of dispersing the color forming phase component and the decolorizing phase component in a binder resin or the like include a method in which melt-kneading the binder resin or the like with an infrared absorber by means of a roll mill, a kneader, a pressure kneader, a Banbury mixer, a Laboplast mill, or a single- or twin-screw kneading extruder, and then finely dispersing the fusing aid components in a solid state material such as the binder resin.

While the degree of the finely dispersing of the fusing aid components varies depending on a polymerizable monomer, a solvent, an aqueous medium, a resin and the like to be added to the dispersing system, the fusing aid component may be dispersed to an extent, for example, that the particle diameter of the decolorizer dispersed in the decolorizing phase component becomes about 0.5 μm or less, and may be preferably to an extent that the particle diameter of the decolorizer dispersed in the decolorizing phase component becomes in the range of about 0.01 μm to about 0.3 μm.

In this case, the melt kneading may be carried out by pressure treatment with a Banbury mixer or an MS pressure kneader in order to achieve dispersibility at the above-described level or more.

The color forming phase component and the decolorizing phase component in the exemplary embodiment are prepared by dissolving or finely dispersing the fusing aid components in a matrix containing the binder resin component and the like to be compounded in the toner. The color forming phase component and the decolorizing phase component may be compounded in advance with other additives such as a charge controlling agent or a colorant to be compounded in the finally produced color toner for flash fusing.

The form of the resulting color forming phase component and the resulting decolorizing phase component is not particularly limited and may be an arbitrary form such as a clump form, a powder form, a scale-like form or a pellet form, while it may be preferably a powder form or a pellet form.

The color forming phase component and the decolorizing phase component, which can be thus prepared, are mixed with the toner components to prepare a toner composition.

The color forming phase component and the decolorizing phase component have the binder resin component and the like as the matrix. Therefore, the amount of each of the toner components incorporated into the toner composition can be regulated with considerations about what functions are demonstrated by the binder resin component when it is incorporated in the toner. For example, when the binder resin component and the like function as a binder resin, the total amount of the binder resin in the toner composition in the toner composition is naturally the sum of the amount of the binder resin component in the color forming phase component and the amount of a resin separately added as a binder resin.

The toner composition may be a resultant obtained by melt-kneading the color forming phase component and the decolorizing phase component with other toner components, or may be a powdery mixture of the color forming phase component, the decolorizing phase component and other toner components to be used in the succeeding melt kneading.

In the method for manufacturing the toner in the exemplary embodiment, the apparatus used in melt kneading the toner composition is not particularly limited. Examples of the apparatus include a roll mill, a kneader, a pressure kneader, a Banbury mixer, a Laboplast mill, and a single- or twin-screw kneading extruder. A premixing process using a Henschel mixer, a super-mixer, a V blender, a tumble blender or the like may also be performed before the melt kneading if necessary.

The heating temperature at the melt kneading is set such that the maximum heating temperature is lower than the melting temperature of the decolorizer used as the fusing aid component. Otherwise, the decolorizer may melt during the melt kneading so that the melted decolorizer may be mixed in a color forming phase to bring about its decolorization action before photoirradiation even if the phase separating structure is formed in the toner. Specifically, the maximum temperature at the melt kneading may be set lower by at least about 5° C. than the melting temperature of the decolorizer.

The toner composition thus melt-kneaded is cooled and then pulverized to form toner particles. The pulverizing method is not particularly limited, and techniques publicly known in the art may be used. For example, the melt-kneaded material can be coarsely pulverized and then pulverized with a micronizer, ULMAX (trade name, manufactured by Nisso Engineering Co., Ltd.), JET-O-MIZER™ (manufactured by Fluid Energy Processing and Equipment Company), KRIPTRON KTM-MODEL (trade name, manufactured by Kawasaki Heavy Industries, Ltd.), a turbo jet mill or the like. The pulverization may be further followed by a post-treatment so that the shape of the pulverized toner may be changed by applying mechanical external force with HYBRIDIZATION SYSTEM (trade name, manufactured by Nara Machinery Co., Ltd.), MECHANO-FUSION SYSTEM (trade name, manufactured by Hosokawa Micron Co., Ltd.), KRIPTRON SYSTEM (trade name, manufactured by Kawasaki Heavy Industries, Ltd.) or the like. The pulverized toner may also be subjected to hot air so as to be spherical. Further, the size distribution of the toner particle may be regulated by classification with an air classifier.

Wet granulation methods can be also used for forming the toner particle. In the case that the toner particle is produced by emulsion polymerization method, which is one example of the wet granulation methods, the emulsion polymerization method may conduct a resin particle-forming, which is namely: firstly adding a monomer such as styrene, butyl acrylate 2-ethylhexyl acrylate or the like to an aqueous solution, in which a water-soluble polymerization initiator such as potassium persulfate is dissolved in advance; adding the leuco dye and the developer; adding a surfactant such as sodium dodecyl sulfate if necessary; and performing polymerization by heating the mixture while stirring so as to give resin particles (the color forming phase component). In a similar manner, the decolorizer is added to a wax, and the resultant is then heated in water to give wax particles (the decolorizing phase component). The emulsion polymerization method may thereafter conduct aggregating, which is namely: adding the colorant to the dispersion, which is a mixture of the color forming phase component and the decolorizing phase component, to form a suspension; adding, if necessary, powders of an infrared absorber, a charge controlling agent and the like to the suspension; and regulating the pH, the stirring intensity, the temperature and the like of the suspension so that the resin particles, colorant powder and wax particles cause heteroaggregation to give hetero-aggregates. The emulsion polymerization method may further conduct fusing (heating), which is namely: heating the resulted reaction system to a temperature higher than the glass transition temperature of the resin particles so that the hetero-aggregates are fused to give colored particles. Thereafter, the colored particles can be washed and dried, and an external additive can be added thereto if necessary, so as to obtain the color toner for flash fusing in the exemplary embodiment of one aspect of the invention. In this case, the maximum temperature in the fusing may also be set lower than the melting temperature of the decolorizer.

In the exemplary embodiment, a polyester resin may be used as the binder resin. When polyester resin is used as the binder resin to form the toner particles by the wet process, the emulsification aggregation method may be used as the wet process. In this case, the resin particle-forming may be replaced by an emulsified particle-forming in which an aqueous medium or the like is mixed with a mixture (polymer solution) containing a sulfonated polyester resin, which may further contain a colorant and the like if necessary, and then the resulted mixture is subjected to shear force so as to form emulsified particles (liquid droplets), whereby colored particles may be prepared. The shape of the toner may vary, and the scope of the shape of the toner ranges from spherical ones to botryoidal ones.

A volume average particle diameter (D50v) of the toner particles obtained by the manufacturing method is preferably in the range of about 3 μm to about 15 μm, more preferably about 5 μm to about 15 μm, and still more preferably about 5 μm to about 10 μm.

When the volume average particle diameter of the toner particles is more than about 15 μm, the particle diameter of the toner may be too large to obtain an image of sufficient resolution. When the particle diameter is less than about 3 μm, it may be poor in fluidity to cause fog and cause insufficient cleaning in some cases, while the resulting image may become excellent in resolution.

The ratio of the volume average particle diameter D50v to the number average particle diameter D50p (D50v/D50p) may be in the range of about 1.0 to about 1.25. By using such toner having a small and uniform particle diameter, fluctuation in the charging performance of the toner may be prevented, thus reducing fog in an image formed by the toner and simultaneously improving the fusibility of the toner. Thin-line reproducibility and dot reproducibility in an image formed by the toner may also be improved.

The average circularity of the toner is preferably about 0.955 or more, and is more preferably about 0.960 or more. The standard deviation of the circularity is preferably about 0.040 or less, and is more preferably about 0.038 or less. When the toner has a shape satisfying these conditions, the toner particles may be superimposed in a condensed state on a recording medium so as to make the thickness of the toner layer on the recording medium thinner and increase the fusing property thereof. In addition, uniformization of the shape of the toner particles contributes to reduction of fogging and improvement in the thin line reproducibility and dot reproducibility of the image formed of the toner.

The average circularity (circular perimeter/actual perimeter) of the toner particle can be calculated by determining the perimeter of the projected image of a particle in an aqueous dispersion system and the circumferential length (circular perimeter) of a circle having an identical area to the projected area of the toner particle by using a flow-type particle image analyzer (trade name: FPIA2000, manufactured by Sysmex Corp.).

White inorganic particles may be added to the toner of the exemplary embodiment for improvement in fluidity of the toner. The amount thereof blended to the toner particle may be in the range of about 0.01 to about 5 parts by mass, and preferably in the range of about 0.01 to about 2.0 parts by mass with respect to 100 parts by mass of the toner particle. Examples of the inorganic particles include silica powder, alumina, titanium oxide, barium titanate, magnesium titanate, calcium titanate, strontium titanate, zinc oxide, quartz sand, clay, mica, wollastonite, diatomaceous earth, chromium oxide, cerium oxide, bengala, antimony trioxide, magnesium oxide, zirconium oxide, barium sulfate, barium carbonate, calcium carbonate, silicon carbide, silicon nitride, and the like, and silica powder is particularly preferable. In addition, any other known materials such as silica, titanium, resin powders, alumina, or the like may be used additionally. Further, metal salts of higher fatty acids, which are typically zinc stearate, or particle powders of a fluorochemical polymer may be added to the toner as a cleaning activator.

The toner of the exemplary embodiment can be prepared by sufficiently blending the inorganic particles and desired additives as needed in a mixer such as a HENSCHEL mixer or the like.

Electrostatic Image Developer

The electrostatic image developer containing the color toner for flash fusing of the exemplary embodiment of one aspect of the invention (hereinafter sometimes abbreviated as a "developer") may be either a single-component developer containing the toner or a two-component developer containing a carrier and the toner.

Examples of the carrier for use in the two-component developer include a resin-coated carrier having a resin coating layer on a surface of a core material thereof. Examples of the core materials include known magnetite, ferrite, and iron powders. The coating agent for the carrier is not particularly limited, while silicone resin-containing agents are particularly preferable.

The average particle diameter of the core material of the carrier is generally preferably in the range of about 10 μm to about 100 μm, and is more preferably in the range of about 20 μm to about 80 μm.

The mixing ratio (mass ratio) of the amount of toner and the amount of the carrier (toner: carrier) in the two-component developer is preferably in the range of about 1:100 to about 30:100, and is more preferably in the range of about 3:100 to about 20:100.

Process Cartridge and Image Forming Apparatus

The image forming apparatus according to one exemplary embodiment of one aspect of the invention is not particularly limited as long as it enables to form, on a recording medium, a full-color image with the color toner for flash fusing of one exemplary embodiment of another aspect of the invention containing by using the developer of one exemplary embodiment of still another aspect of the invention. Specific examples of the image forming apparatus include that having at least a toner image forming member that forms a toner image on a recording medium by using the electrostatic image developer and a fusing member to fuse the toner image by photoirradiation so that the fused toner image is fixed onto the recording medium.

When a photoreceptor for electrophotography is used as the electrostatic image-holding member, the image formation may be performed, for example, as follows. First, the surface of the photoreceptor for electrophotography is charged uniformly in a Corotron electrostatic charging device, a contact electrostatic charging device, or the like, and exposed to light, forming an electrostatic image. Then, a toner image is formed on the photoreceptor for electrophotography by bringing the photoreceptor into contact with or closer to a developing roll carrying a surface developer layer and thus adhering toner particles onto the electrostatic image. The toner image formed is then transferred onto the surface of an image-receiving medium such as paper by using a Corotron electrostatic charging device or the like. Further, the toner image transferred onto the recording medium surface is then fixed by using a fixing device, forming an image on the recording medium.

In the image forming apparatus, the part including the developing roll may have a cartridge structure (process cartridge) attachable to, and detachable from, the main body of the image forming apparatus. Examples of the process cartridge include that containing at least a developer bearing body and accommodating the electrostatic image developer of the exemplary embodiment.

Typical examples of the photoreceptors for electrophotography include inorganic photoreceptors such as amorphous silicon or selenium; and organic photoreceptors using polysilane, phthalocyanine or the like as a charge-generating material or an electric charge-transferring material, and an amorphous silicon photoreceptor is particularly preferable as it has a longer lifetime.

The fusing device can be any device as long as it can conduct fusing by light. A flash fusing device can be used when the color toner for flash fusing of the exemplary embodiment of one aspect of the invention is utilized.

Examples of the light source for use in the flash fusing include common halogen lamps, mercury lamps, flash lamps, infrared lasers, and the like, and among them, instantaneous fixing by a flash lamp is most preferable for energy saving. The emission energy of the flash lamp is preferably in the range of about 1.0 J/cm$^2$ to about 7.0 J/cm$^2$ and is more preferably in the range of about 2 J/cm$^2$ to about 5 J/cm$^2$.

The emission energy of a flash light per unit area, an indicator of the intensity of a xenon lamp strength, is represented by the following Equation (1).

$$S=((1/2)\times C\times V^2)/(u\times L)\times(n\times f) \qquad \text{Equation (1)}$$

In Equation (1), n represents the number of the lamps lighted at the same time; f represents a lighting frequency (Hz); V represents an input voltage (V); C represents a condenser capacity (F); u represents a process traveling speed (cm/s); L represents the effective lighting width of the flash lamps (usually, the maximum paper width (cm)); and S represents an energy density (J/cm$^2$).

The flash fusing process may be a delayed process in which multiple flash lamps are lightened at a time interval. The delayed process is a process of placing multiple flash lamps in a row, lighting the respective lamps at an interval of about 0.01 ms to about 100 ms, and irradiating the same area of a toner image multiple times. In this manner, the process, which applies fractioned light energies, not all at once, but several times onto a toner image, makes the fixing condition milder and provides both superior void resistance and fixing efficiency.

When a toner image is irradiated with flash lights multiple times, the emission energy of the flash lamps herein means the total amount of the emission energies per unit area of respective flash lights.

In the invention, the number of the flash lamps is preferably in the range of about 1 to about 20 and is more preferably in the range of about 2 to about 10. Additionally, the time interval between the multiple flash lamp lighting is preferably in the range of about 0.1 msec to about 20 msec and is more preferably in the range of about 1 msec to about 3 msec.

Yet additionally, the emission energy of single flash lamp lighting is preferably in the range of about 0.1 to about 1 J/cm$^2$ and is more preferably in the range of about 0.4 to about 0.8 J/cm$^2$.

An example of the image-forming apparatus having a flash fusing device which flash-fuses the color toner for flash fusing of the exemplary embodiment of one aspect of the invention will be described below with reference to drawings.

FIG. 1 is a schematic view illustrating an example of the image-forming apparatus of the exemplary embodiment. FIG. 1 is a view of an apparatus forming a toner image by using three color toners in cyan, magenta, and yellow In FIG. 1, 1*a* to 1*c* each represent an electrostatic charging device; 2*a* to 2*c* each represent an exposure apparatus; 3*a* to 3*c* each represent an electrostatic image-holding member (photoreceptor); 4*a* to 4*c* each represent a developing device; 5*a* to 5*d* each represent a color forming device; 10 represents a recording paper (recording medium) fed from a roll medium 15 in the arrow direction; 20 represents a cyan developing unit; 30 represents a magenta developing unit; 40 represents a yellow developing unit; 50 represents a black developing unit; 70*a* to 70*c* each represent a transfer device (transfer roller); 71 and 72 each represent a roller; 80 represents a transfer voltage-supplying device; and 90 represents a flash fusing device.

The image-forming apparatus shown in FIG. 1 has developing units for toners different in color represented by 20, 30, 40 and 50, each having an electrostatic charging device, an exposure apparatus, a photoreceptor, and a developing device; rolls 71 and 72 for conveying a recording paper 10 placed in contact with the recording paper 10; transfer rolls 70*a*, 70*b*, 70*c* and 70*d* for pressing the recording paper 10 onto the photoreceptors of respective developing units that are placed on the other side of the recording paper with respect to the photoreceptor; a transfer voltage-supplying device 80 for supplying a voltage to the three transfer rolls; and a flash fusing device 90 for irradiating a light onto the photoreceptor side of the recording paper 10 that is traveling through the nip areas between the photoreceptors and the transfer rolls in the direction indicated by the arrows in FIG. 1.

In the image-forming apparatus shown in FIG. 1, not only the developing devices 4*a* to 4*c* but also the developing units 20, 30, 40 and 50 may work as process cartridges.

In the cyan developing unit 20 an electrostatic charging device 1*a*, an exposure apparatus 2*a*, and a developing device 4*a* are placed clockwise around a photoreceptor 3*a*. In addition, the transfer roll 70*a* is placed on the other side of the recording paper 10 so that transfer roll 70*a* comes into contact with the surface of the photoreceptor 3*a* via the recording paper 10 in the area between the position of the developing device 4*a* and the electrostatic charging device.

Other developing units for toners different in color also have the same structure. In the image-forming apparatus according to the exemplary embodiment, the developing device 4*a* in the developing unit 20 is loaded with a developer containing the above-described cyan toner and the developing devices of the other developing units are respectively loaded with the toners for flash fusing corresponding to the respective other colors.

Image formation using the image-forming apparatus will be described below. First, the surface of the photoreceptor 3*d* is charged by the electrostatic charging device 1*d* while the photoreceptor 3*d* is rotated in the clockwise direction in the black developing unit 50. A latent image corresponding to the black component image of an original image to be copied is then formed on the surface of the photoreceptor 3*d*, by photoirradiation of the surface of the charged photoreceptor 3*d* by the exposure device 2*d*. Then, the latent image is further developed into a black toner image by application of the black toner loaded in the developing device 4*d*. The same process also proceeds in the yellow developing unit 40, the magenta developing unit 30 and the cyan developing unit 20, forming toner images in respective colors on the photoreceptor surfaces of respective developing units.

The respective toner images formed on the photoreceptor surface are transferred one by one onto the recording paper 10 conveyed in the arrowed direction by the transfer voltage applied through the transfer rolls 70*a* to 70*d*, forming a full-color layered toner image corresponding to the original image information in cyan, magenta, yellow and black in that order from the top on the surface of the recording paper 10.

Subsequently, the layered toner image formed on the recording paper 10 is conveyed to the flash fusing device 90, where the layered toner image is fused by photoirradiation by the flash fusing device to form a flash fused full-color image on the recording paper 10. The decolorizer may work, for example, at this stage to bring the color-forming state of the leuco dye to the decolorized state.

The color toner for flash fusing in the exemplary embodiment may be used in various applications such as newspaper, service bureau, bar code printing, label printing, tag printing, printers in a Carlson system or an ion-flow system or copies. The color toner for flash fusing in the exemplary embodiment may provide inexpensive products exhibiting excellent flash fixability, and may thus easily cope with demand for colorization of images in these applications.

EXAMPLES

Hereinafter, the present invention will be described more specifically with reference to Examples, while the invention is not limited thereby.

Preparation of Toners

The compounds represented by Formula (I) are used as the leuco dyes in the following examples. The specific partial structures such as substituents and the λmax value of the compounds are shown in the following Table 1. In the columns for $X^1$ or $X^2$ in Table 1, "-" means that the m or n in Formula (I) is zero, "o-" and "p-" respectively mean that the m or n in Formula (I) is one, and "m, p" means that the m or n in Formula (I) is two. The λmax value is the wave length at an absorption peak of each of the compounds which is forming color due to activated clay and is placed in methanol-stannic chloride.

TABLE 1

| Compound No. | $R^1$ | $R^2$ | $X^1$ | $X^2$ | λmax |
|---|---|---|---|---|---|
| 1 | $CH_3$ | $CH_3$ | — | p-$OCH_3$ | 890 |
| 2 | $CH_3$ | $CH_3$ | — | p-$CH_3$ | 900 |
| 3 | $CH_3$ | $CH_3$ | — | m.p $(CH_3)_2$ | 900 |
| 4 | $C_2H_5$ | $C_2H_5$ | — | p-$OCH_3$ | 890 |
| 5 | $C_2H_5$ | $C_2H_5$ | o-$OC_3H_7$ | p-$OCH_3$ | 820 |
| 6 | $C_2H_5$ | $C_5H_{11}$ | — | p-$OCH_3$ | 890 |
| 7 | $CH_3$ | 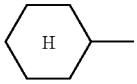 | — | p-$OCH_3$ | 900 |
| 8 | $C_2H_5$ | 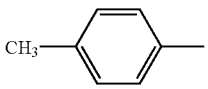 | — | p-$CH_3$ | 910 |

Preparation of Color Forming Phase Component and Decolorizing Phase Component According to the formulations shown in Tables 2 and 3, the leuco dye (any one of compound Nos. 1 to 8), the developer and the binder resin are mixed, and separately the decolorizer are mixed with the wax. These resultants are respectively melt kneaded (mixed) at 135° C. with an extruder (trade name: PCM-30, manufactured by Ikegai Corporation), whereby a color forming phase component and a decolorizing phase component are prepared respectively. The term "parts" in the table is an abbreviation of "parts by mass".

The compound (trade name: TG-SA, manufactured by Nippon Kayaku Co., Ltd.), the structure of which is shown in Structural formula 1 below, is used as the developer for the leuco dyes. Lithocholic acid (melting temperature of 180° C., manufactured by Nacalai Tesque, Inc.) is used as the decolorizer.

Structural Formula 1

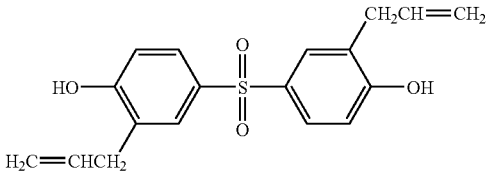

Then, a toner material that contains the color forming phase component, the decolorizing phase component, a charge controlling agent, an infrared absorber and a colorant such that the composition in the final toner will become a composition shown in Tables 2 and 3, is introduced into a Henschel mixer and preliminarily mixed therewith, and further kneaded at 250 rpm with an extruder (trade name: PCM-30, manufactured by Ikegai Corporation) at 135° C. (except that only CT-26 is processed at 230° C.). Then, the composition is coarsely milled with a hammer mill, then finely milled with a jet mill, and classified with an air classifier to give the respective toner particles having a volume average particle diameter of 4.6 μm.

These toner particles were embedded in an epoxy resin which is then sliced with a microtome to prepare a sliced sample. When sections of the particles in the sample are observed with TEM, a phase-separating structure in which wax phases having a maximum diameter of about 1.5 μm have been dispersed in at least the binder resin is confirmed.

Then, 2.0 parts by mass of hydrophobic silica particles (trade name: TG820F, manufactured by Cabot Corporation) are externally added to 98 parts by mass of the respective toner particles using a Henschel mixer to give color toners for flash fusing (CT-2 to 6, 8 to 11, and 13 to 26) used in the Examples and color toners for flash fusing (CT-1, 7, and 12) in the Comparative examples.

TABLE 2

| | Amount of leuco dye added (parts) | | | | | | | |
|---|---|---|---|---|---|---|---|---|
| Toner | Compound 1 | Compound 2 | Compound 3 | Compound 4 | Compound 5 | Compound 6 | Compound 7 | Compound 8 |
| CT-1 | 2.0 | — | — | — | — | — | — | — |
| CT-2 | 2.0 | — | — | — | — | — | — | — |
| CT-3 | 2.0 | — | — | — | — | — | — | — |
| CT-4 | 2.0 | — | — | — | — | — | — | — |
| CT-5 | 2.0 | — | — | — | — | — | — | — |
| CT-6 | 2.0 | — | — | — | — | — | — | — |
| CT-7 | 2.0 | — | — | — | — | — | — | — |
| CT-8 | 2.0 | — | — | — | — | — | — | — |
| CT-9 | 2.0 | — | — | — | — | — | — | — |
| CT-10 | 2.0 | — | — | — | — | — | — | — |
| CT-11 | 2.0 | — | — | — | — | — | — | — |
| CT-12 | — | — | — | — | — | — | — | — |
| CT-13 | 0.5 | — | — | — | — | — | — | — |
| CT-14 | 1.0 | — | — | — | — | — | — | — |
| CT-15 | 4.0 | — | — | — | — | — | — | — |
| CT-16 | 10.0 | — | — | — | — | — | — | — |
| CT-17 | — | 2.0 | — | — | — | — | — | — |

| | | | Other components (parts) | | | | | | | |
|---|---|---|---|---|---|---|---|---|---|---|
| | Developer | Decolorizer | Binder resin | Charging regulator | Wax | | Infrared | Cyan | Magenta | Yellow |
| Toner | (parts) | (parts) | Polyester | PSY | 800P | WEP-5F | absorber | pigment | pigment | pigment |
| CT-1 | 3.0 | — | 85.0 | 0.5 | 2 | 0.5 | — | — | — | 5.0 |
| CT-2 | 3.0 | 0.2 | 84.8 | 0.5 | 2 | 0.5 | — | — | — | 5.0 |
| CT-3 | 3.0 | 1.0 | 84.0 | 0.5 | 2 | 0.5 | — | — | — | 5.0 |
| CT-4 | 3.0 | 4.0 | 81.0 | 0.5 | 2 | 0.5 | — | — | — | 5.0 |
| CT-5 | 3.0 | 10.0 | 75.0 | 0.5 | 2 | 0.5 | — | — | — | 5.0 |
| CT-6 | 3.0 | 20.0 | 65.0 | 0.5 | 2 | 0.5 | — | — | — | 5.0 |
| CT-7 | — | 4.0 | 84.0 | 0.5 | 2 | 0.5 | — | — | — | 5.0 |
| CT-8 | 0.3 | 4.0 | 83.7 | 0.5 | 2 | 0.5 | — | — | — | 5.0 |
| CT-9 | 1.0 | 4.0 | 83.0 | 0.5 | 2 | 0.5 | — | — | — | 5.0 |
| CT-10 | 10.0 | 4.0 | 74.0 | 0.5 | 2 | 0.5 | — | — | — | 5.0 |
| CT-11 | 20.0 | 4.0 | 64.0 | 0.5 | 2 | 0.5 | — | — | — | 5.0 |
| CT-12 | 3.0 | 4.0 | 83.0 | 0.5 | 2 | 0.5 | — | — | — | 5.0 |
| CT-13 | 3.0 | 4.0 | 82.5 | 0.5 | 2 | 0.5 | — | — | — | 5.0 |
| CT-14 | 3.0 | 4.0 | 82.0 | 0.5 | 2 | 0.5 | — | — | — | 5.0 |
| CT-15 | 3.0 | 4.0 | 79.0 | 0.5 | 2 | 0.5 | — | — | — | 5.0 |
| CT-16 | 3.0 | 4.0 | 73.0 | 0.5 | 2 | 0.5 | — | — | — | 5.0 |
| CT-17 | 3.0 | 4.0 | 81.0 | 0.5 | 2 | 0.5 | — | — | — | 5.0 |

TABLE 3

| | Amount of leuco dye added (parts) | | | | | | | |
|---|---|---|---|---|---|---|---|---|
| Toner | Compound 1 | Compound 2 | Compound 3 | Compound 4 | Compound 5 | Compound 6 | Compound 7 | Compound 8 |
| CT-18 | — | — | 2.0 | — | — | — | — | — |
| CT-19 | — | — | — | 2.0 | — | — | — | — |
| CT-20 | — | — | — | — | 2.0 | — | — | — |

TABLE 3-continued

| | | | | | | | | |
|---|---|---|---|---|---|---|---|---|
| CT-21 | — | — | — | — | — | 2.0 | — | — |
| CT-22 | — | — | — | — | — | — | 2.0 | — |
| CT-23 | — | — | — | — | — | — | — | 2.0 |
| CT-24 | 2.0 | — | — | — | — | — | — | — |
| CT-25 | 2.0 | — | — | — | — | — | — | — |
| CT-26 | 2.0 | — | — | — | — | — | — | — |

| | | | Other components (parts) | | | | | | | |
|---|---|---|---|---|---|---|---|---|---|---|
| | Developer | Decolorizer | Binder resin | Charging regulator | Wax | | Infrared | Cyan | Magenta | Yellow |
| Toner | (parts) | (parts) | Polyester | PSY | 800P | WEP-5F | absorber | pigment | pigment | pigment |
| CT-18 | 3.0 | 4.0 | 81.0 | 0.5 | 2 | 0.5 | — | — | — | 5.0 |
| CT-19 | 3.0 | 4.0 | 81.0 | 0.5 | 2 | 0.5 | — | — | — | 5.0 |
| CT-20 | 3.0 | 4.0 | 81.0 | 0.5 | 2 | 0.5 | — | — | — | 5.0 |
| CT-21 | 3.0 | 4.0 | 81.0 | 0.5 | 2 | 0.5 | — | — | — | 5.0 |
| CT-22 | 3.0 | 4.0 | 81.0 | 0.5 | 2 | 0.5 | — | — | — | 5.0 |
| CT-23 | 3.0 | 4.0 | 81.0 | 0.5 | 2 | 0.5 | — | — | — | 5.0 |
| CT-24 | 3.0 | 4.0 | 80.5 | 0.5 | 2 | 0.5 | 0.5 | — | — | 5.0 |
| CT-25 | 3.0 | 4.0 | 81.0 | 0.5 | 2 | 0.5 | — | 5.0 | — | — |
| CT-26 | 3.0 | 4.0 | 81.0 | 0.5 | 2 | 0.5 | — | — | 5.0 | — |

Cyan pigment: Pigment Blue 15:3 (trade name: Blue No. 4, manufactured by Dainichiseika Colour & Chemicals Mfg. Co., Ltd.)
Magenta pigment: Pigment Red 122 (trade name: ECR186Y, manufactured by Dainichiseika Colour & Chemicals Mfg. Co., Ltd.)
Yellow pigment: C.I. Pigment Yellow 185 (trade name: Baryotol Y-D1155, manufactured by BASF Ltd.)
Wax: polyethylene wax (trade name: 800P, manufactured by Mitsui Chemicals, Inc.) ester wax (trade name: WEP-5F, manufactured by NOF Corporation)
Charging regulator: quaternary ammonium salt (trade name: PSY, manufactured by Clariant Japan)
Binder resin: polyester resin (trade name: FP118, manufactured by Kao Corporation)
Infrared absorber: Chroconium compound (trade name: ST-173, manufactured by Fuji Film Corporation)

Preparation of Developer

Two-component developers containing each of the thus obtained toners are formed. A carrier used therein is a ferrite carrier for general purpose which has a volume-average particle diameter of 40 μm and has a silicone resin coating. 5 parts by mass of each of the toners is added to 95 parts by mass of the carrier, and the resultant mixture is blended in a 10-L ball mill for 2 hours, to obtain 100 parts of each two-component developer.

Examples 1 to 23 and Comparative Examples 1 to 3

The prepared color toners CT-1 to CT-26 and the developers containing them are measured for their absorbance at 900 nm before and after photoirradiation and evaluated for their on-machine properties as shown below.

Measurement of Absorbance of the Toner

According to the measurement method described above, each toner is used to prepare a measurement sample and measured for absorbance A1 at 900 nm before photoirradiation. Then, each measurement sample is irradiated with light for 1 msec under a condition of 3.5 mJ/cm$^2$ with a flash lamp and then measured for absorbance A2 after the photoirradiation in an analogous manner, to determine the absorbance ratio (A2/A1, %) before and after the photoirradiation.

The results are collectively shown in Tables 4 and 5.

Evaluation of On-Machine Properties

Evaluations of properties of image including fusibility and color reproducibility are carried out using each developer containing the toner as shown in Tables 4 and 5. The apparatus used in the evaluations is a rebuilt version of Fuji Xerox 490/980 Continuous Feed printer (manufactured by Fuji Xerox Co., Ltd.) loaded with a xenon flash lamp as a flash fusing device. The approximate configuration of the apparatus accords to that illustrated in FIG. 1. The emission energy of the flash lamp is set at 3.5 J/cm$^2$.

Evaluation of Fusibility

Plain paper (trade name: NIP-1500LT, manufactured by Kobayashi Create Co., Ltd.) is used as a recording medium to form an image of 1 inch×1 inch (2.54 cm×2.54 cm) in size by the image forming apparatus. Specifically, each color toner for flash fusing shown in Tables 4 and 5 is used to form an image in which the amount of the adhering toner (the amount of the toner on the recording medium) is regulated to be 0.5 mg/cm$^2$ in a single color.

Then, the fusing ratio of the resulting image of 1 inch×1 inch in size (2.54 cm×2.54 cm) is evaluated in the following manner. First, a status A density (OD1) corresponding to each color of the image is measured, and then an adhesive tape (trade name: Scotch Mending Tape, manufactured by Sumitomo 3M Ltd.) is adhered to the image. Thereafter, the adhesive tape is peeled off, and then a status A density (OD2) corresponding to each color of the image is measured. The optical density is measured with a spectrometer (trade name: 938 Spectrodentitometer, manufactured by X-Rite). Then, the optical densities thus determined are used to calculate the fusing ratio according to the following Equation (2).

$$\text{Fusing ratio (\%)} = (OD2/OD1) \times 100 \qquad \text{Equation (2):}$$

From the fusing ratio calculated according to Equation (2), fusibility is evaluated under the following criteria.

A: The fusing ratio is 90% or more.

B: The fusing ratio is 80% or more to less than 90%.

C: The fusing ratio is 70% or more to less than 80%.

X: The fusing ratio is less than 70% (level at which the toner is hardly usable).

Evaluation of Color Reproducibility

Each of the toners is used to prepare gray-scale samples in which the amount of the adhering toner is 0.48 to 0.52 mg/cm$^2$ and the toner dot ratio is changed every 5% from 0 to 100%. After fusing, the measured values of color reproducibility (L*, a*, b*) at a portion with a toner dot ratio of 80% are evaluated respectively. The image used for the evaluation is that resulted one minute after the fusing. The values of L*, a*, and b* are measured with a spectrometer (trade name: 938

Spectrodentitometer, manufactured by X-Rite). The differences between these measurements and the color reproducibility target values of Japan Color are respectively evaluated in terms of color difference ΔE. The ΔE (color difference) means $\{(L_0^*-L_1^*)^2+(a_0^*-a_1^*)^2+(b_0^*-b_1^*)^2\}^{1/2}$. $L_0^*$, $a_0^*$, and $b_0^*$ are the color reproducibility target values of Japan Color, and $L_1^*$, $a_1^*$, and $b_1^*$ are measured values of the color reproducibility of the toner image.

The color reproducibility target values of Japan Color are (L*: 59, a*: −24, b*: −41) for cyan toner, (L*: 54, a*: 55, b*: −1) for magenta toner, and (L*: 89, a*: −7, b*: 71) for yellow toner.

The measurement method is based on "Standardization in Graphic Technology", Japan Printing Machinery Manufacturers, ISO/TC130 Japanese National Commission, Japanese Society of Printing Science and Technology, revised in August, 2003. The numerical values are the L*, a* and b* values of wood free paper shown in Table 4, page 7 of the literature.

Color reproducibility of each of the Examples and Comparative examples is evaluated under the following judgment criteria.

A: ΔE≦3

B: 3<ΔE≦8

C: 8<ΔE≦15

X: 15<ΔE

The evaluation results are collectively shown in Tables 4 and 5.

Example 24

A toner for Example 24 is prepared by melt kneading and milling in the same manner as in Example 2 except that a toner material thereof which has the same composition as in the toner (CT-4) used in Example 3, is introduced all at once into a Henschel mixer, without the preliminary formation of a color forming phase component and decolorizing phase component.

When the toner is evaluated in the same manner as in Example 1, the absorbance ratio at 900 nm after photoirradiation is about 40%, and the fusibility in on-machine evaluation is 73%, which are inferior in fusibility to the other examples.

As shown in Tables 4 and 5, images of the Examples formed of the toners containing the fusing aid which causes decolorization by photoirradiation achieve high optical fusibility and simultaneously show excellent color reproducibility. On the other hand, the toners of the Comparative examples, which do not use the fusing aids, cause problems in any one of the on-machine properties.

The foregoing description of exemplary embodiments of the present invention has been provided for the purpose of illustration and description. It is not intended to be exhaustive or to limit the invention to the precise forms disclosed. Obviously, many modifications and variations will be apparent to practitioners skilled in the art. The embodiments were chosen and described in order to best explain the principles of the

TABLE 4

| | Toner No. | Absorbance ratio after photoirradiation (vs. before light irradiation, %) | Evaluation results: Fusibility | | Evaluation results: Color reproducibility |
|---|---|---|---|---|---|
| Example 1 | CT-2 | 60 | 85% | B | C |
| Example 2 | CT-3 | 25 | 85% | B | B |
| Example 3 | CT-4 | 5 | 85% | B | B |
| Example 4 | CT-5 | 5 | 80% | B | B |
| Example 5 | CT-6 | 5 | 75% | C | B |
| Example 6 | CT-8 | 75 | 85% | B | C |
| Example 7 | CT-9 | 10 | 85% | B | B |
| Example 8 | CT-10 | 5 | 80% | B | B |
| Example 9 | CT-11 | 5 | 70% | C | B |
| Example 10 | CT-13 | 80 | 70% | C | C |
| Example 11 | CT-14 | 55 | 75% | C | C |
| Example 12 | CT-15 | 5 | 90% | A | B |
| Example 13 | CT-16 | 65 | 95% | A | C |

TABLE 5

| | Toner No. | Absorbance ratio after photoirradiation (vs. before light irradiation, %) | Evaluation results: Fusibility | | Evaluation results: Color reproducibility |
|---|---|---|---|---|---|
| Example 14 | CT-17 | 5 | 85% | B | B |
| Example 15 | CT-18 | 5 | 85% | B | B |
| Example 16 | CT-19 | 5 | 85% | B | B |
| Example 17 | CT-20 | 15 | 80% | B | B |
| Example 18 | CT-21 | 10 | 85% | B | B |
| Example 19 | CT-22 | 10 | 85% | B | B |
| Example 20 | CT-23 | 10 | 85% | B | B |
| Example 21 | CT-24 | 20 | 100% | A | B |
| Example 22 | CT-25 | 5 | 85% | B | B |
| Example 23 | CT-26 | 5 | 85% | B | B |
| Comparative example 1 | CT-1 | 100 | 85% | B | X |
| Comparative example 2 | CT-7 | 100 | 85% | B | X |
| Comparative example 3 | CT-12 | 100 | 30% | X | B |

invention and its applications, thereby enabling others skilled in the art to understand the invention for various embodiments and with the various modifications as are suited to particular use contemplated. It is intended that the scope of the invention be defined by the following claims and their equivalents.

All publications, patent applications, and technical standards mentioned in this specification are herein incorporated by reference to the same extent as if each individual publication, patent application, or technical standard was specifically and individually indicated to be incorporated by reference.

What is claimed is:

1. A color toner for flash fusing comprising: a binder resin, a colorant, a leuco dye, a developer and a decolorizer, an absorbance of the color toner after photoirradiation at a wavelength of about 900 nm being smaller than an absorbance of the color toner before the photoirradiation at the wavelength of about 900 nm, wherein the leuco dye has a structure represented by the following Formula (I):

Formula (I)

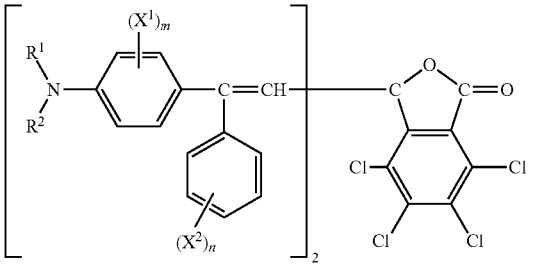

wherein $R^1$ represents an alkyl group having 1 to 8 carbon atoms; $R^2$ represents an alkyl group having 1 to 8 carbon atoms, a cycloalkyl group having 5 to 7 carbon atoms, a benzyl group that may have one or more substituent selected from a chlorine atom, a bromine atom and an alkyl group having 1 to 4 carbon atoms, or a phenyl group that may have one or more substituent selected from a chlorine atom, a bromine atom and an alkyl group having 1 to 4 carbon atoms; $X^1$ and $X^2$ each independently represent an alkyl group having 1 to 8 carbon atoms, an alkoxy group having 1 to 8 carbon atoms, a fluorine atom, a chlorine atom, a bromine atom, or a combination thereof; and m and n each independently represent an integer of 0 to 3; and wherein the developer is hexadecyl gallate, octadecyl gallate, eicosyl gallate, docosyl gallate, or a metal salt thereof, or 4,4'-dihydroxy-3,5'-diallyldiphenylsulfonyl.

2. The color toner for flash fusing according to claim 1, wherein the absorbance of the color toner after photoirradiation at a wavelength of about 900 nm is about 50% or less of the absorbance of the color toner before the photoirradiation at the wavelength of about 900 nm.

3. The color toner for flash fusing according to claim 1, wherein an absorption peak of the leuco dye which is in a color-forming state is in the range of about 800 nm to about 1,000 nm.

4. The color toner for flash fusing according to claim 1, wherein an amount of the leuco dye in the color toner is in the range of about 0.5 parts by mass to about 10.0 parts by mass relative to 100 parts by mass of the color toner.

5. The color toner for flash fusing according to claim 1, wherein an amount of the developer in the color toner is in the range of about 0.3 parts by mass to about 20.0 parts by mass relative to 100 parts by mass of the color toner.

6. The color toner for flash fusing according to claim 1, wherein a mass ratio (A/B) of an amount A of the leuco dye in the color toner to an amount B of the developer in the color toner is in the range of about 2/0.3 to about 2/20.

7. The color toner for flash fusing according to claim 1, wherein a melting temperature of the decolorizer is in the range of about 100° C. to about 250° C.

8. The color toner for flash fusing according to claim 1, wherein an amount of the decolorizer in the color toner is in the range of about 0.2 parts by mass to about 20.0 parts by mass relative to 100 parts by mass of the color toner.

9. The color toner for flash fusing according to claim 1, wherein a mass ratio (C/D) of an amount C of the developer in the color toner to an amount D of the decolorizer in the color toner is in the range of about 3/0.2 to about 2/20.

10. The color toner for flash fusing according to claim 1, wherein the absorbance of the color toner before photoirradiation at a wavelength of about 900 nm is in the range of about 0.2 to about 2.

11. The color toner for flash fusing according to claim 1, wherein a particle of the color toner has a phase-separating structure which comprises a plurality of phases at the inside of the particle, and the phases comprise a phase which comprises the leuco dye and the developer and is different from a phase which comprises the decolorizer.

12. The color toner for flash fusing according to claim 1, further comprising a wax.

13. The color toner for flash fusing according to claim 11, wherein the phase which comprises the decolorizer further comprises a wax, and the decolorizer is dispersed in the wax.

14. The color toner for flash fusing according to claim 12, wherein a mass ratio (E/F) of an amount E of the binder resin in the color toner to an amount F of the wax in the color toner is in the range of about 100/0.01 to about 100/5.

15. The color toner for flash fusing according to claim 1, wherein a volume average particle diameter D50v of particles of the color toner is in the range of about 3 μm to about 15 μm.

16. The color toner for flash fusing according to claim 1, wherein a ratio (D50v/D50p) of a volume average particle diameter D50v of particles of the color toner to a number average particle diameter D50p of particles of the color toner is in the range of about 1.0 to about 1.25.

17. The color toner for flash fusing according to claim 1, wherein an average circularity of particles of the color toner is about 0.955 or more.

18. An electrostatic image developer comprising the color toner of claim 1.

19. A process cartridge comprising a developer bearing body, and the electrostatic image developer of claim 18.

20. An image forming apparatus comprising: a toner image forming member that forms a toner image on a recording medium; the electrostatic image developer of claim 18; and a fusing member to fuse the toner image by photoirradiation so that the fused toner image is fixed onto the recording medium.

21. The image forming apparatus according to claim 20, wherein a light source of the fusing member is a flash lamp.

22. The image forming apparatus according to claim 21, wherein the emission energy of the flash lamp is in the range of about 1.0 J/cm$^2$ to about 7.0 J/cm$^2$.

* * * * *